United States Patent [19]

Suechting

[11] 4,087,210

[45] May 2, 1978

[54] HYDRAULIC PUMPING DEVICE WITH PNEUMATIC ACTUATION

[75] Inventor: William G. Suechting, Okauchee Lake, Wis.

[73] Assignee: Hein-Werner Corporation, Waukesha, Wis.

[21] Appl. No.: 653,254

[22] Filed: Jan. 28, 1976

Related U.S. Application Data

[62] Division of Ser. No. 432,751, Jan. 11, 1974, Pat. No. 3,949,644.

[51] Int. Cl.[2] ..... F04B 17/00; F04B 35/00

[52] U.S. Cl. ..... 417/401; 91/341 A

[58] Field of Search ..... 417/401, 402, 399, 903; 91/313, 224, 309, 290, 304, 341 R, 341 A; 92/110

[56] References Cited

U.S. PATENT DOCUMENTS

| | | | |
|---|---|---|---|
| 1,448,486 | 3/1923 | Garraway | 91/313 |
| 1,519,599 | 12/1924 | Street | 91/313 |
| 1,674,614 | 6/1928 | Berkman | 91/341 A |
| 2,544,094 | 3/1951 | Knowles | 91/224 |
| 2,588,164 | 3/1952 | Roberts et al. | 417/401 |
| 3,041,975 | 7/1962 | Atherton et al. | 417/401 |
| 3,134,304 | 5/1964 | Hager | 91/341 R |
| 3,174,409 | 3/1965 | Hill | 91/313 |
| 3,218,980 | 11/1965 | Arnes | 91/49 |
| 3,788,781 | 1/1974 | McClocklin | 417/401 |

*Primary Examiner*—Carlton R. Croyle
*Assistant Examiner*—Thomas I. Ross
*Attorney, Agent, or Firm*—Michael, Best & Friedrich

[57] ABSTRACT

A pneumatic-hydraulic pumping device including a jacket member, a cap member mounted at one end of the jacket member and an hydraulic head member mounted at the opposite end of the jacket member. An air head member is mounted in the jacket member intermediate the cap and hydraulic head members to form an air piston chamber between the cap member and the air head member and an hydraulic fluid reservoir space in the jacket between the hydraulic head member and the air head member. An air piston means including a piston head and a piston rod fastened thereto is mounted for reciprocal movement in power stroke and exhaust directions inside the air piston chamber with the piston rod being slidably mounted in the air head member. An air piston return means is mounted in the jacket for moving the piston means in the exhaust stroke direction. The air head member is connected to a source of air pressure by a conduit means. An air valve means is mounted in the air head member for controlling the flow of air into and out of the air piston chamber to thereby control the reciprocal movement of the air piston means. An hydraulic pumping means is mounted in the reservoir space and operatively connected to the air piston means for actuation thereby.

10 Claims, 6 Drawing Figures

34
36
14
26
162
28
24
164
156
32
140
102
17

34
6
86
96
97
100
12
118
58
108
106
102
82
178
84
80
116
88
76
5
56
104
110
98
48
44
94
114
90
92
113
112
162
26
126
115
190
36
38
166
124
192
194
128
40
42
30
136
24
138
22
4
170
17
10
32
140

HYDRAULIC PUMPING DEVICE WITH PNEUMATIC ACTUATION

CROSS REFERENCE TO RELATED APPLICATION

This application is a division of our application, Ser. No. 432,751, filed Jan. 11, 1974, now U.S. Pat. No. 3,949,644.

BACKGROUND OF THE INVENTION

I. Field of the Invention

This invention relates to a pneumatic-hydraulic pumping device and more particularly to a combination air motor and hydraulic pump both of which are of novel design.

II. Description of the Prior Art

Prior pneumatic-hydraulic pumping devices known to applicants are shown in U.S. Pat. Nos. 3,041,975, 3,079,900 and 3,218,980. The pneumatic-hydraulic pumping unit of the present invention is designed to provide a unit having greater efficiency in the operation of both the air motor and the hydraulic pump which operates at a relatively low sound level and will provide a dependable unit of relatively low cost because of its relatively simple design wherein many of the parts provide multiple functions.

SUMMARY OF THE INVENTION

A fluid motor comprising a body having a piston chamber formed therein and a piston means including a piston head and a piston rod fastened thereto mounted for reciprocal movement in the piston chamber with the piston head having a power face and exhaust face on opposite sides thereof. A fluid pressure means is provided which includes a conduit means for communicating a source of fluid pressure with the power face of the piston head to cause the piston to be moved in a power stroke direction. A return means is provided for moving the piston in an exhaust stroke direction. A valve means is provided for connecting the piston power face with a source of fluid pressure when the piston means reaches the end of its exhaust stroke and for cutting off the piston power face from the source of fluid pressure when the piston means reaches the end of its power stroke. The valve means is further operative to connect the portion of the piston chamber opposite the piston power face with the portion of the piston chamber opposite the piston exhaust face when the piston reaches the end of its power stroke. A vent means is provided for venting the portion of the power chamber opposite the piston exhaust face as the piston means is reciprocated in both its power stroke and exhaust stroke directions.

DESCRIPTION OF THE PREFERRED EMBODIMENT

Figure 1:
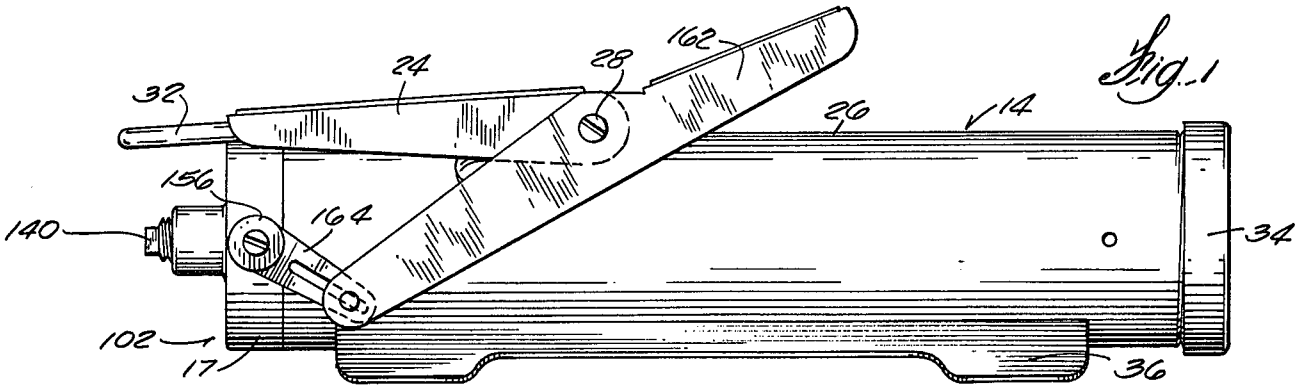
FIG. 1 is a side elevation view of an air hydraulic pump unit which embodies the invention of this application.

Referring to the drawings in detail, the air hydraulic pump unit of this invention is comprised of three basic sub-assemblies, namely: an hydraulic pump assembly 10, a fluid or air motor assembly 12 and a jacket assembly 14.

Figure 4:
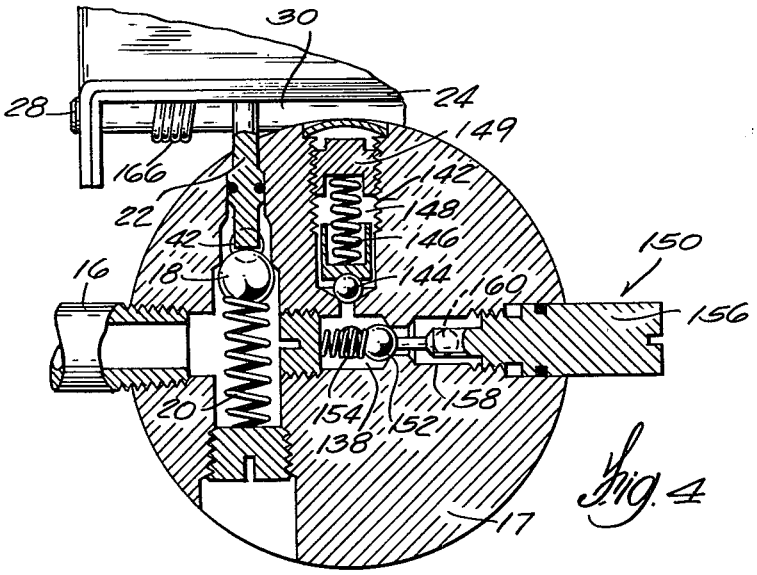
FIG. 4 is a sectional view taken along line 4—4 of FIG. 3.

Air for actuation of the air motor 12 is admitted to the unit through an air inlet fitting 16 threaded into hydraulic head member 17 of hydraulic pump assembly 10 as shown in FIG. 4. The flow of air into the unit is controlled by an air control ball valve 18 which is biased to its closed position by a compression spring 20 and actuated to its open position by a valve actuating plunger member 22. Valve plunger 22 is actuated by an air treadle member 24 pivotally mounted on the top of the cylindrical jacket 26 by a pair of machine screws 28, 28 threaded into the ends of a rod support member 30 which is welded or otherwise secured to the top surface of cylindrical jacket member 26. Treadle member 24 is provided with a handle portion 32 which serves as a carrying handle for the unit when the treadle 24 is pivoted to a vertical position.

In addition to jacket member 26, jacket assembly 14 is comprised of an end cap 34 threaded on one end of jacket 26 and a foot support member 36 fastened to the bottom portion of jacket 26 by a stud 38 and a nut 40.

Figure 3:
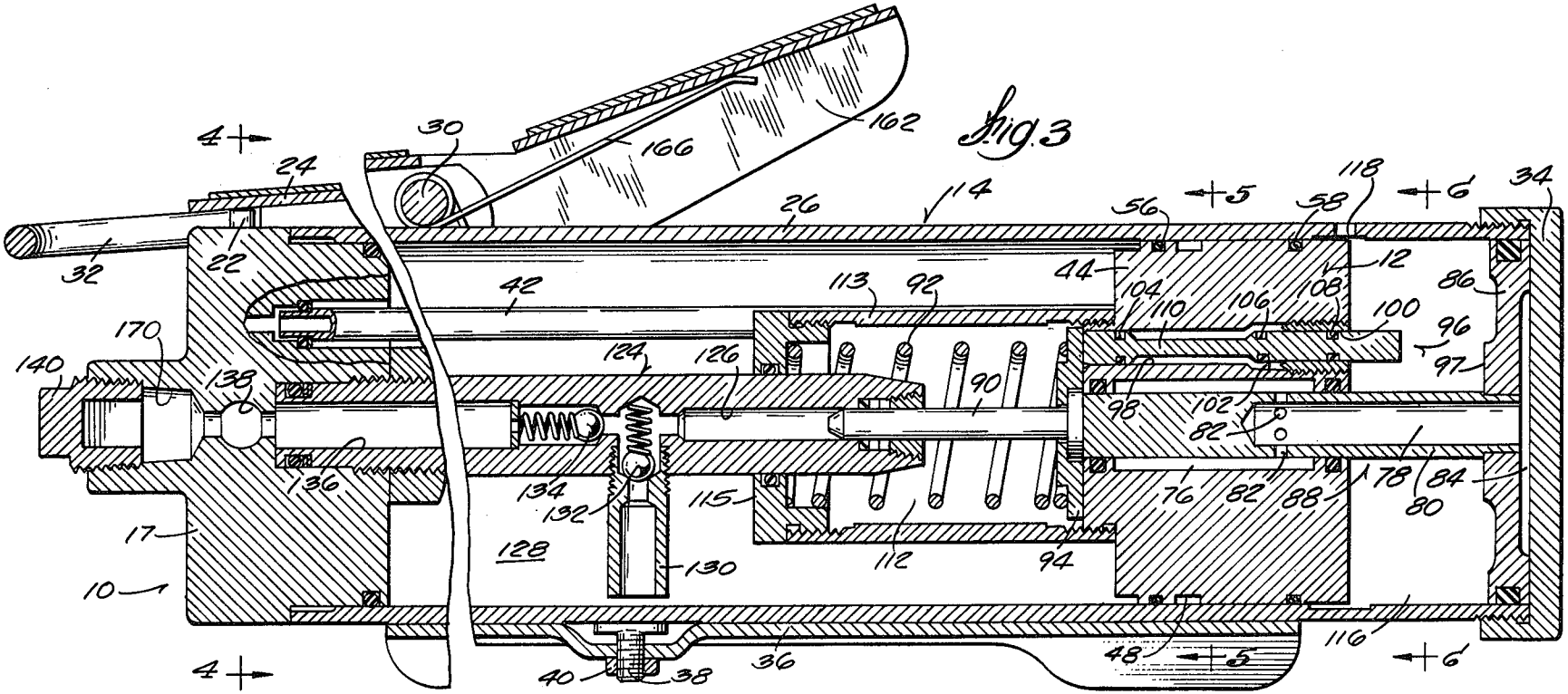
FIG. 3 is a sectional view taken along line 3—3 of FIG. 2 (with some parts broken away)
Figure 2:
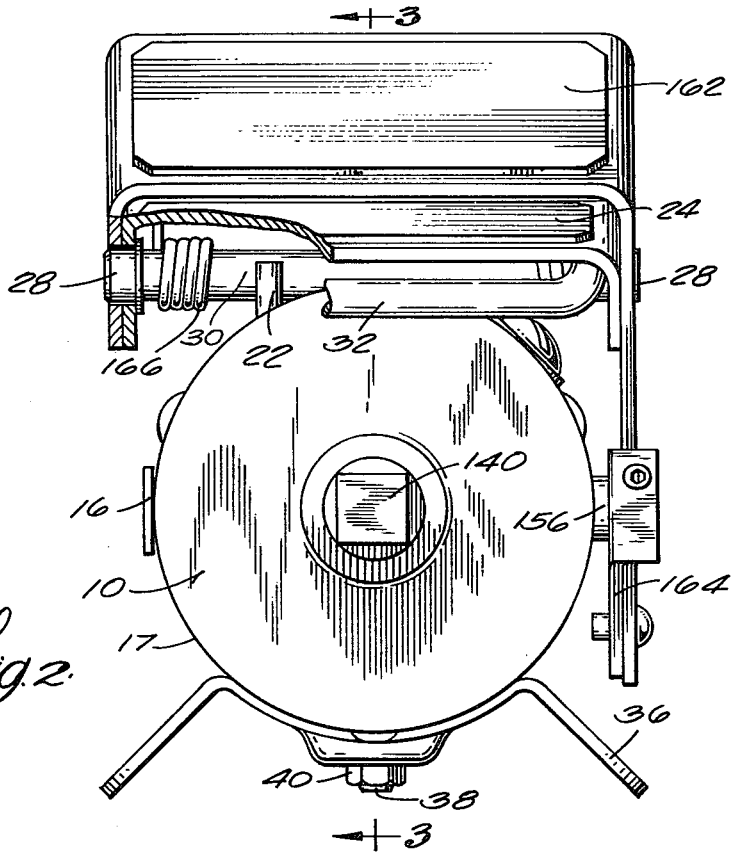
FIG. 2 is an end view of the unit shown in FIG. 1.
Figure 5:
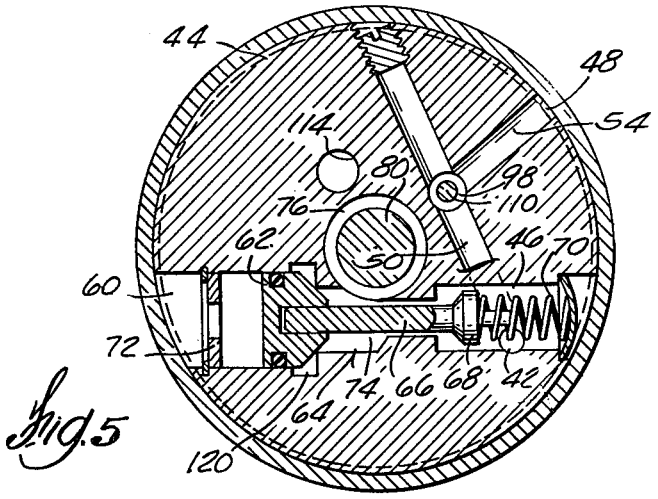
FIG. 5 is an offset sectional view taken along line 5—5 of FIG. 3.

When air valve 18 is actuated, air will flow from fitting 16 into an air tube 42 which is clamped between hydraulic head 17 and air motor head 44 of air motor assembly 12. The end of tube 42 extends into a port in the face of air head 44 and empties into a servo chamber 46 as shown in FIG. 5. Air will then flow from chamber 46 to a chamber 48 through a transverse port 50, a longitudinal port 98 and a transverse port 54. As best shown in FIG. 3, chamber 48 is in the shape of an annular groove in the outer surface of air head 44 and is sealed by a pair of O-rings 56 and 58. It will be appreciated that FIG. 5 does not represent a sectional view taken in a single plane through head 44 but instead represents a sectional view taken in two closely adjacent planes selected to show the porting inside the head.

The air entering chamber 48 will flow circumferentially around head 44 through chamber 48 to a chamber 60 located opposite the head 62 of a servo valve member 64. Servo valve 64 is comprised of a large operating head 62, a stem 66, a small valve head 68 and a spring 70 which biases valve head 68 to its closed position and operating head 62 to its open position. A retainer member 72 with an opening therethrough is mounted in chamber 60 to retain the servo valve in assembled position.

The air entering chamber 60 will exert pressure on the face of head 62, causing the servo valve to move to its power stroke position against the bias of spring 70 and the air pressure in chamber 74 as shown in FIG. 5. The valve will remain in power stroke position as long as the air pressure in chamber 60 is sufficient to overcome the bias of spring 70 and the air pressure in chamber 74 acting on the rear face of head 62. When the servo valve 64 is actuated to such power stroke position, air will flow from chamber 46 past servo valve head 68 into a chamber 74. From chamber 74 the air will flow into a chamber 76 and then into a chamber 78 inside piston rod 80 through radial ports 82, as shown in FIG. 3.

Air flowing into chamber 78 will flow therethrough to power chamber 84 on the power side of air piston head 86, which head together with rod 80 forms an air piston assembly 88. Pressurization of chamber 84 will actuate air piston assembly 88 in its power stroke direction to the left (FIG. 3). Such movement will in turn actuate hydraulic piston rod 90 in its power stroke to the left against the bias of return spring 92 by means of piston retainer member 94 as best shown in FIG. 3.

As air piston assembly 88 moves to the left, the back face 97 of piston head 86 will contact the end of a control valve member 96, causing it to be actuated to the left as shown in FIG. 3. Valve member 96 is slidably mounted in a cylindrical cavity having a wall area 98 of reduced diameter at one end, a wall area 100 of reduced diameter at the other end and a wall area 102 of larger diameter intermediate the two end wall areas. Valve member 96 is provided with O-ring sealing members 104, 106 and 108, and has a central portion 110 of reduced diameter.

Upon initial actuation of valve member 96 by piston head 86, O-ring 106 will move into sealing engagement with wall area 98. This will shut off communication between the source of air pressure from tube 42 and the chamber 60 opposite the head 62 of servo valve 64.

Even though air pressure to chamber 60 is thus cut off, air under pressure will be momentarily trapped in chamber 60, causing servo valve 64 to remain stationary in its FIG. 5 position.

Continued movement of control valve member 96 to its full exhaust position will cause O-ring 104 to move out of engagement with wall area 98 to thus vent the servo chamber 60 to atmosphere. The air flow path for such venting is first from chamber 60 through ports 48 and 54 into chamber 112 in which spring 92 is mounted and then back through air head 44 through longitudinal port 114 (FIG. 5) and then into the exhaust chamber 116 opposite the back face 97 of air piston head 86 and then out to atmosphere through vent opening 118 in jacket member 26. Chamber 112 is defined by a sleeve member 113 threaded onto air head 44 and a cap member 115 threaded into the open end of the sleeve 113 (FIG. 3). The above described momentary cut-off of air to chamber 60 prior to the venting of chamber 60 will prevent any tendency of air piston 86 to stall as it reaches the end of its power stroke.

As indicated previously, movement of control valve member 96 to its full exhaust position will cause O-ring member 106 to move into sealing engagement with wall 98 to thereby shut off communication between air inlet tube 42 and transverse port 54 (FIG. 5) thereby cutting off air pressure to servo chamber 60.

Figure 6:
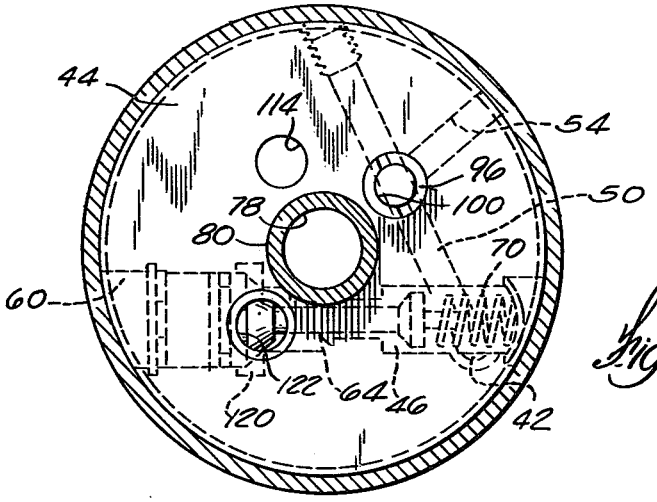
FIG. 6 is a sectional view (with parts broken away) taken along line 6—6 of FIG. 3.

When chamber 60 is vented and air pressure to it is shut off, servo valve 64 will be actuated to its exhaust position by return spring 70 and the air in chamber 74, which in turn will cut off communication between air inlet tube 42 and power chamber 84 on the power side of air piston head 86. At the same time chamber 74 (and chamber 76) will be placed into communication with a chamber 120 (FIG. 5) to thereby allow air to flow from power chamber 84 through chamber 78, radial ports 82, chamber 76, chamber 74 into chamber 120. Such air will then flow into both exhaust chamber 116 and into chamber 112 through a longitudinal port 122 in air head 44 as shown in FIG. 6.

Thus it is seen that when air piston assembly 88 reaches the end of its power stroke, air pressure to power chamber 84 is cut off and at the same time chamber 84 is placed into communication with exhaust chamber 116 on the exhaust side of the piston head. As this occurs, return spring 92 will be able to move piston assembly 88 to the right (FIG. 3) causing the volume of power chamber 84 to be gradually reduced and at the same time causing the volume of exhaust chamber 116 to be gradually increased. Thus during the exhaust stroke of piston assembly 88, air in chamber 84 will flow continuously from chamber 84 into chamber 116 and then out to atmosphere through vent 118. This rapid dissipation of air under pressure from power chamber 84 into the expanding exhaust chamber 116 (and chamber 112) and then out to atmosphere during the exhaust stroke produces several desirable operational features.

First, the rapid dissipation of the compressed air from power chamber 84 to the expanding internal exhaust chamber 116 before it is exhausted to atmosphere results in a much quieter operation than would be the case where the compressed air was exhausted from the power chamber directly to atmosphere. Secondly, the flow of the exhaust air through the exhaust chamber 116 will prevent any tendency of a vacuum forming in such chamber which would tend to retard the return or exhaust movement of the piston under the bias of return spring 92. Not only will it prevent any tendency to produce a vacuum but will actually provide a positive force to aid spring 92 in the exhaust stroke. Thus air motor 12 operates in a manner to provide a relatively constant flow of air out from exhaust chamber 116 through vent 118 during both the power and exhaust strokes of the piston assembly 88. A much smoother and quieter operation results.

As piston assembly 88 reaches the end of its exhaust stroke, piston retainer member 94 will contact the left end of control valve member 96 and slide it from its exhaust position back to the right to its power position as shown in FIG. 3. The initial movement of member 96 will cause O-ring member 104 to move into sealing engagement with wall 98. This will shut off communication between servo chamber 60 and the vent to atmosphere. Continued movement of control valve 96 to its full power stroke position will cause O-ring 106 to move out of engagement with wall area 98 to thus reestablish communication between the source of air pressure from tube 42 and the chamber 60 opposite the head 62 of servo valve 64. Thus with chamber 60 cut off from vent 118 and with chamber 60 connected to air inlet tube 42 the servo valve member 66 will be actuated in a positive manner back to its power stroke position (FIG. 5). This will initiate another power stroke of the air piston assembly 88 as previously described. The above described sequential pressurization of chamber 60 and subsequent shut off of the chamber from the vent will insure a positive actuation of servo valve member 66 and thereby prevent any tendency of air piston 86 to stall as it reaches the end of its exhaust stroke.

The above described operation of the control valve 96 in cooperation with the servo valve 64 provides a relatively slow movement of the piston assembly 88 during its exhaust stroke. This provides certain advantages in the operation of the hydraulic pump assembly as will be explained hereinafter.

Turning now to the construction and operation of hydraulic pump assembly 10, such assembly includes an hydraulic piston rod 90 and an hydraulic body member 124 sealed at one end in an opening in cap member 115 and threaded at the other end into hydraulic head member 17. Rod 90 is positioned to reciprocate in cylindrical pumping chamber 126 formed inside body member 124.

When rod 90 is reciprocated by the air motor 12, its intake stroke to the right (FIG. 3) will draw oil (or other hydraulic fluid) from reservoir space 128 through tube 130 and check valve 132 into pump chamber 126. Rod 90 in its pressure stroke to the left will force oil from chamber 126 through check valve 134, through chamber 136 in body 124, through chamber 138 in head 17 and then out the outlet port 170. A plug 140 can be threaded into port 170 when the unit is shipped.

As indicated previously, air motor 12 operates with a relatively slow exhaust stroke which in turn will produce a relatively slow intake stroke for the hydraulic pump 10. This in turn will maximize the amount of hydraulic fluid drawn into chamber 126 on the intake stroke and thus minimize the likelihood of cavitation in the pump.

A pressure relief valve 142 is provided as shown in FIG. 4. Valve 142 is comprised of a ball valve 144 biased to its closed position by a spring 146. When pressure in chamber 138 exceeds a certain predetermined value, ball valve 144 will be forced off its seat to allow flow into chamber 148 and then back into reservoir 128 through a port (not shown). The setting of pressure relief valve 142 can be varied by varying the degree to which threaded spring retainer plug 149 is screwed into threaded chamber 148.

A manual pressure release valve 150 is also provided. Valve 150 is comprised of a ball member 152 biased to its closed position by a spring 154 and a threaded actuator plug 156 adapted when rotated into threaded chamber 158 to force ball 152 off its seat to thereby allow flow from chamber 138 into chamber 158 and then from there back into reservoir 128 through a port 160 (shown in dotted lines in FIG. 4). As best shown in FIG. 1, actuator plug 156 is controlled by a treadle member 162 pivotally mounted on the top portion of jacket assembly 14. Treadle member 162 is operatively connected to actuator plug 156 by a link member 164 so that when treadle member is pivoted, plug 156 will be rotated to thereby force ball 152 off its seat.

OPERATION

While the air hydraulic pump unit of this invention can be used in a number of different applications, assume for purposes of explanation that it is used to supply hydraulic fluid under pressure to a lift mechanism for automobiles. When it is desired to provide fluid under pressure to the lift mechanism, the air motor is started by the operator by pivoting air treadle member 24 downwardly by exerting pressure thereon by the operator's toe. As long as treadle member 24 is held in its operating position, fluid under pressure will be delivered through port 170 to the lift mechanism through a suitable hose (not shown). When it is desired to stop the delivery of fluid under pressure and allow the fluid already delivered to the lift mechanism to return to the reservoir 128 of the unit, the operator will release air treadle member 24 and depress treadle member 162. This is simply accomplished by raising the toe of the foot and at the same time depressing the heel of the foot on treadle 162. By depressing treadle 162 against the bias of spring 166, release valve 150 will be actuated to its open position to thereby allow return flow of the hydraulic fluid back into reservoir 128.

As indicated previously, one of the principal advantages of the above described air hydraulic unit is that it will operate at a relatively low sound level, requiring no special apparatus for muffling the sound produced by its operation. Another important advantage of the above described design is that is produces a dependable operating unit of relatively low cost because of its relatively simple design wherein many of the parts provide multiple functions.

Another important advantage is the relatively slow exhaust stroke of the air motor which provides a corresponding slow intake stroke for the hydraulic pump. This minimizes the likelihood of cavitation in the pump and thus increases its efficiency.

Finally it is noted that by mounting the hydraulic pump in jacket 14 between hydraulic head 17 and air head 44 both of which are sealed to the jacket by resilient O-ring members, problems of mis-alignment between the parts of the hydraulic pump and the air motor are minimized.

I claim:

1. An air operated hydraulic pumping device comprising:

a jacket member;

a cap member mounted at one end of said jacket member;

a hydraulic head member mounted at the opposite end of said jacket member;

an air head member mounted in said jacket member intermediate said cap and hydraulic members;

an air piston chamber in said jacket member between said cap member and said air head member;

an hydraulic fluid reservoir space in said jacket member between said hydraulic head member and said air head member;

an air piston means including a piston head and a piston rod fastened thereto mounted for reciprocal movement in power stroke and exhaust stroke directions in said air piston chamber, said piston rod being slidably mounted in said air head member;

air piston return means mounted in said jacket for moving said piston means in an exhaust stroke direction;

air pressure means including a conduit means connecting an air pressure source with said air head member;

air valve means mounted in said air head member for controlling the flow of air into and out of said air piston chamber to thereby control the reciprocal movement of said air piston means;

an hydraulic pumping means mounted in said reservoir space and operatively connected to said air piston means for actuation thereby;

said piston head of said air piston means having a power face facing said cap member and an exhaust face facing said air head member, said air valve means being operative to connect said piston power face with said air pressure source when said air piston means reaches the end of its exhaust stroke, said air valve means being further operative to cut off said piston power face from said air pressure source when said air piston means reaches the end of its power stroke and to connect the portion of said air piston chamber adjacent said piston power face with the portion of said air piston chamber adjacent said piston exhaust face during the exhaust stroke of said air piston means;

said jacket member including a vent means for venting the portion of said air piston chamber adjacent said exhaust face of said piston head as said air piston means reaches the end of its power stroke; and a conduit means communicating air pressure from said air head member to said power face of said air piston.

2. An air operated hydraulic pumping device according to claim 1 in which said air valve means includes a slidably mounted control valve member adapted for actuation in one direction as said air piston means moves in its power stroke direction and adapted for actuation in the opposite direction as said air piston means moves in its exhaust stroke direction.

3. An air-operated hydraulic pumping device according to claim 2 in which said slidably mounted control valve member is mechanically actuated in said one direction and in said opposite direction by said air piston means.

4. An air operated hydraulic pumping device according to claim 1 in which said air valve means includes a slidably mounted servo valve member, said servo valve member adapted to be actuated in one direction by fluid pressure and in the opposite direction by fluid pressure.

5. An air operated hydraulic pumping device according to claim 4 in which the servo valve member connects said piston power face with a source of fluid pressure when actuated in said one direction and disconnects said piston power face from a source of fluid pressure when actuated in said opposite direction.

6. An air operated hydraulic pumping device according to claim 5 in which said valve means further includes a slidably mounted control valve member adapted for actuation in one direction as said air piston means moves in its power stroke direction and adapted for actuation in the opposite direction as said air piston means moves in its exhaust stroke direction.

7. An air operated hydraulic pumping device according to claim 6 in which said control valve member when actuated in said one direction will disconnect the source of air pressure from said servo valve.

8. An air operated hydraulic pumping device according to claim 7 in which said control valve member when actuated in said one direction will connect said servo valve with said vent means.

9. An air operated hydraulic pumping device according to claim 1 in which said conduit means of said air pressure means includes an air passage located inside said air piston rod.

10. An air operated hydraulic pumping device comprising:

a substantially cylindrical jacket member;

a circular cap member mounted at one end of said jacket member;

a circular hydraulic head member mounted at the opposite end of said jacket member, said hydraulic head member sealed to said jacket member by means of at least one resilient O-ring member;

a circular air head member mounted in said jacket member intermediate said cap and hydraulic head members, said air head member sealed to said jacket member by means of at least one resilient O-ring member;

an air piston chamber in said jacket member between said cap member and said air head member;

an hydraulic fluid reservoir space in said jacket member between said hydraulic head member and said air head member;

an air piston means including a piston head and a piston rod fastened thereto mounted for reciprocal movement in power stroke and exhaust stroke directions in said air piston chamber, said piston rod being slidably mounted in said air head member on the axis of said jacket member;

air piston return means mounted in said jacket for moving said piston means in an exhaust stroke direction;

air pressure means including a conduit means connecting an air pressure source withe said air head member;

air valve means mounted in said air head member for controlling the flow of air into and out of said air piston chamber to thereby control the reciprocal movement of said air piston means; and an hydraulic pumping means mounted in said reservoir space and operatively connected to said air piston means for actuation thereby, said hydraulic pumping means being comprised of an hydraulic body member and an hydraulic piston rod slidably mounted in said hydraulic body member on the axis of said jacket member, said hydraulic body member supported at one end by said hydraulic head member and at the other end by said air head member.

* * * * *